United States Patent [19]

Clarke

[11] Patent Number: 4,699,247

[45] Date of Patent: Oct. 13, 1987

[54] LADDER LEVELLING DEVICE

[76] Inventor: James B. Clarke, 120 Shepherds Hill, Harold Wood, Essex, England

[21] Appl. No.: 760,739

[22] PCT Filed: Aug. 15, 1985

[86] PCT No.: PCT/GB84/00427

§ 371 Date: Jul. 19, 1985

§ 102(e) Date: Jul. 19, 1985

[87] PCT Pub. No.: WO85/02650

PCT Pub. Date: Jun. 20, 1985

[30] Foreign Application Priority Data

Dec. 15, 1983 [GB] United Kingdom ..... 8333488

[51] Int. Cl.[4] ..... E06C 7/44

[52] U.S. Cl. ..... 182/107; 182/200; 248/188.2

[58] Field of Search ..... 182/107, 108, 200; 248/188.2

[56] References Cited

U.S. PATENT DOCUMENTS

| | | | |
|---|---|---|---|
| 2,767,032 | 10/1956 | Mitchell | 182/222 |
| 3,086,612 | 4/1963 | McKinley | 182/200 |
| 3,199,629 | 8/1965 | Fagaly | 182/200 |
| 3,993,275 | 11/1976 | Lucas | 182/200 |
| 4,069,890 | 1/1978 | Gottliebsen | 182/108 |
| 4,135,335 | 1/1979 | Jensen | 248/188.2 |
| 4,304,318 | 12/1981 | Webb | 248/188.2 |
| 4,456,095 | 6/1984 | Hodson | 182/200 |

FOREIGN PATENT DOCUMENTS

| | | | |
|---|---|---|---|
| 1367489 | 9/1974 | United Kingdom | 182/107 |

*Primary Examiner*—Reinaldo P. Machado

*Attorney, Agent, or Firm*—Kane, Dalsimer, Kane, Sullivan and Kurucz

[57] ABSTRACT

A device for supporting simultaneously the bottom ends of both stiles of a ladder from sloping ground, so that the rungs of the ladder are horizontal, comprises a reversible triangular platform, which is supported from the ground by three feet, one of which spaces the respective corner of the platform at a greater height above the ground than the other two feet.

12 Claims, 11 Drawing Figures

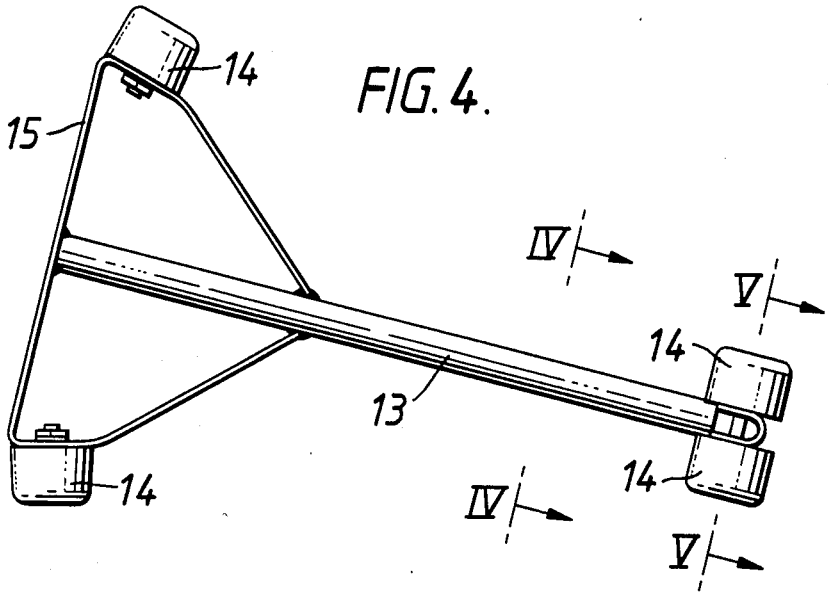
FIG. 4.
FIG. 5.
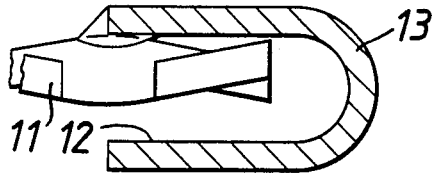
FIG. 6.
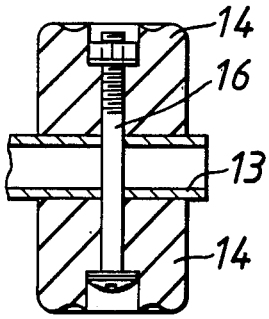

LADDER LEVELLING DEVICE

When a ladder is erected in the correct disposition, both its lower stile ends should be resting on a firm surface, and the rungs should be horizontal. These requirements can rarely be met concurrently since typical ground surfaces are not usually both flat and horizontally level.

Two common solutions, which are employed, involve packing and wedging. It if fortuitous if packing is of the correct thickness and makeshift attempts to fill out may be fragile and usually unstable. Wedges for supporting the lower end of one stile are disclosed in U.S. Pat. Nos. 3,993,275 and 4,304,318. However, such a wedge is also unstable since, if the ladder is rocked from side to side in use, the wedge is prone to move as the load is removed from the wedge and reapplied, and there is then a tendency for the stiles of the ladder to "walk" or rotate about the axis of one stile. Also the devices disclosed in these two documents have straight rigid ground engaging side edges and these will rock on any local raised ground.

Attachments, such as that disclosed in GB-A-1367489, which are rigidly attached to the bottom of a ladder, are known, but these are time consuming and difficult to use, make it difficult to move the ladder, require adjustment each time the ladder is moved, and are prone to jamming of the moving parts.

In accordance with the present invention, a device for simultaneously supporting the bottom ends of both the stiles of a ladder from the ground comprises an upper surface which is supported by ground engaging feet, and so constructed that when the feet are resting on horizontal ground, the upper surface presents a graded range of heights such that when the ladder stiles are rested on the upper surface, the relative heights of the stiles from the ground may be altered by a change of location of the stiles on the upper surface, whereby the device can be selectively positioned on level or sloping ground so that both stiles of a ladder may be rested on the device with the ladder rungs horizontal.

With this construction, any ladder can be readily levelled on level or sloping ground by appropriate manipulation of the device between the lower stile ends and the ground. The upper surface may have stepped and/or inclined parts and will be arranged so that the device can space the bottom ends of both ladder stiles from the ground by the substantially same distance when the ground is substantially level, or by variously different distances when the ground is sloping.

In addition to levelling the ladder, the device may be arranged to provide on the lower stile ends a reaction with a component directed towards the base of a wall against which the ladder is leaning, when standing on the device, to inhibit any tendency for the lower end of the ladder to stip outwards across the device in the direction away from the wall.

One important feature of the new device is that its upper surface is large enough to support the lower ends of both ladder stiles. As a result, in the event of one side of the ladder lifting in use, for example as a result of movement of a user climbing or standing on the ladder, the full weight of the ladder and user will remain on the device, preventing movement of the device and any consequential tendency of the ladder to "walk" or twist.

A second important feature is that the device is provided with feet which support the device locally with the rest of the device spaced above the ground. This provides for stable support on uneven ground. Three feet will always provide such stable support but two wide feet or more than three feet are not excluded. For example, they may be flexible or flexibly mounted, e.g. pivotally mounted in pairs, so that they can adjust to the unevenness of the ground.

In one particularly cheap and convenient construction, the upper surface is the upper surface of a substantially triangular platform having, adjacent to each of its three corners, a respective one of the ground engaging feet. For example, when the device is resting with the feet on level ground, one edge of the upper surface of the triangular platform may be horizontal and the opposite corner is at a different height. When the device is standing on level ground, the platform will be inclined and, in use on sloping ground, a low corner of the platform may be placed under a first ladder stile, which is positioned over the higher ground with the ramp face of the platform facing the front climbing side of the ladder, and the platform rotated about the bottom of the first stile so that the platform ramp moves under the other ladder stile to fill the gap between the bottom of that stile and lower ground. The normal reaction between the ramp and the bottom of the ladder stiles will then provide the previously referred to reaction component towards the wall to inhibit slip of the bottom of the ladder across the device.

In order that the device may be applied to a ladder in this way irrespective of whether the left or right stile of the ladder is positioned above the higher or lower ground, the upper and lower surfaces of the platform, with feet projecting therefrom, are preferably mirror images of one another so that the device may be used with a selected one of the platform surfaces uppermost depending upon the slope of the ground.

In an alternative construction, the upper surface is provided on a linear support along which the ladder stiles are adjustably positionable, the upper surface extending at an inconstant inclination when the feet are resting on the ground.

In order to level a ladder on a device of this kind, the lower ends of the ladder stiles and the linear support will be moved relatively to one another in the longitudinal direction of the support until the appropriate spacing is provided between the lower ends of the stiles and the ground immediately beneath the two stiles.

The upper surface of the linear support may be inclined in the same sense from one end to the other, in which case the device will need to be positioned so that it extends along the wall with the high end at one end or the other depending upon the direction of slope of the ground. Alternatively, if the upper surface has oppositely inclined end portions, i.e. is convex or concave upwardly, slopes in different directions can be accommodated merely by positioning the ladder stiles towards one or other end of the support.

The upper surface of the support may be indented, for example provided between two bars, or by a channel or angular section, to locate the ladder stiles against movement transversely to the length of the support, and hence provide the previously mentioned reaction to inhibit outward sliding of the lower end of the ladder across the device.

Provision may be made for securing the ladder to the device to inhibit a change of the angle at which the ladder extends upwards from the device.

Some examples of devices constructed in accordance with the present invention are illustrated in the accompanying drawings, in which:

FIG. 4 is a side elevation of the first device;

FIG. 5 is a section taken on the line IV—IV in FIG. 4;

FIG. 6 is a section taken on the line V—V in FIG. 4;

Figure 1:
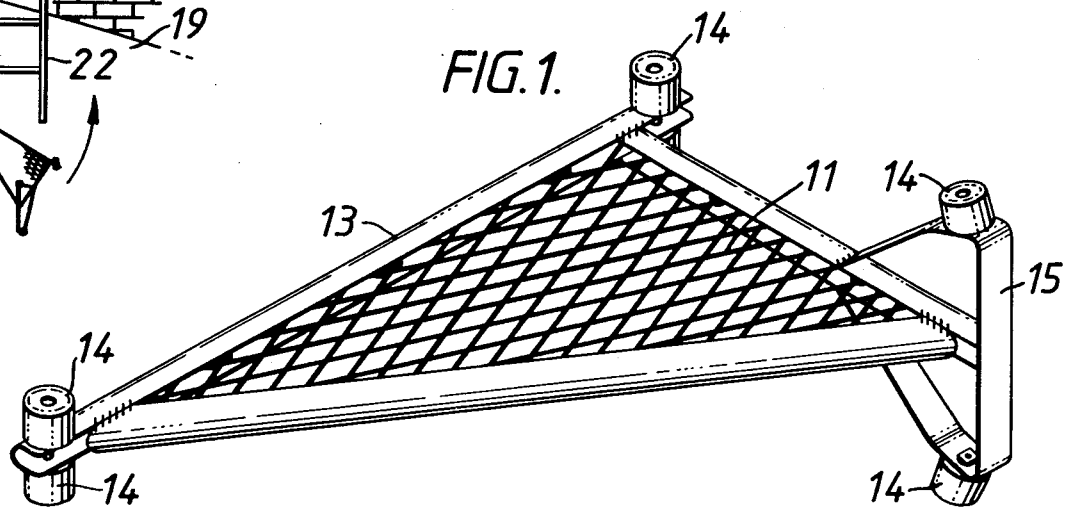
FIG. 1 is a perspective view of one device.

The first device comprises a platform formed by a right angular triangular sheet 11 of expanded metal, the edges of which are welded within an inwardly facing channel 12 of a surrounding rigid triangular frame 13. Neoprene feet 14 project from both surfaces, at each corner, of the platform. The feet at the corner of the platform which is formed at the intersection of the hypotenuse and shorter side of the triangle, are spaced from the platform by being mounted on a bracket 15 which is welded to the frame. The other two pairs of feet 14 are similar to one another and secured to the ends of the frame side opposite to the bracket 15, by means of respective bolts, as shown in FIG. 5. The two faces of the device are thus mirror images of one another.

Figure 2:
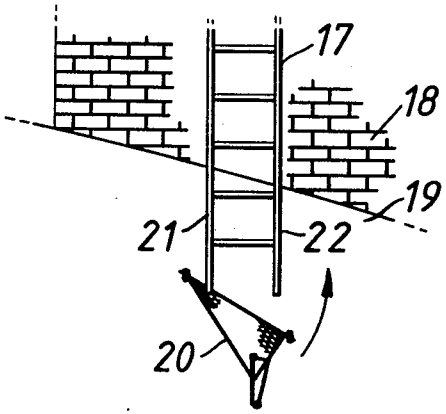
FIG. 2 is a diagrammatic view showing the first device in use.
Figure 3:
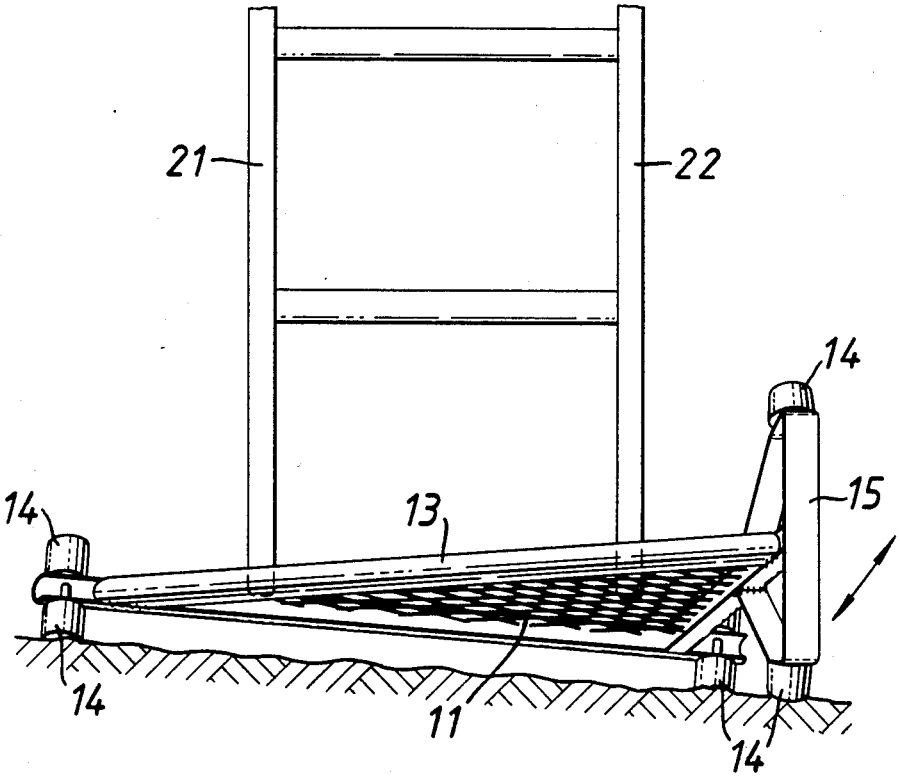
FIG. 3 is a front view of the device in use.

As shown in FIGS. 2 and 3, the lower ends of the stiles of a ladder 17, which is resting against a wall 18, may be supported from transversely sloping ground 19 by means of one of the devices 20. The corner of the device further from the bracket 15 is inserted between the higher ground and the bottom end of one ladder stile 21, and the rest of the device is then swung under the bottom end of the other stile 22, as shown by the arrow in FIG. 2. The platform then forms a ramp facing towards the wall 18, which inhibits outward sliding of the bottom of the ladder across the platform.

FIGS. 7 to 11 show a different type of device having a substantially linear support with an upper surface along with the lower ends of the siles of a ladder may be adjustably positioned. Thus the device shown in FIG. 7 has an upwardly convex support formed by a metal strip which is bent to provide a central section 23, which is horizontal, when the device is standing on level ground, oppositely inclined sections 24, and end portions 25. One end portion 25 carries a foot 26 and the other end portion 25 carries a bar 27 which in turn carries a pair of feet 28. A back plate 29 is welded to one edge of the metal strip and projects above the strip, so that the support is essentially of angular section. This device will be used with the metal strip projecting from the back plate 29 towards the wall and with the stiles of the ladder resting on the metal strip against the back plate 29. Appropriate positioning of the ladder stiles along the metal strip will compensate for any lateral slope of the ground on which the device rests.

For added stability, the bar 27 may be extended as at 27′ so that the foot 28 becomes the foot 28′. A similar bar 27″ may extend from the portion 25 and carry a fourth foot 28″. A device with four feet will still rest in stable fashion on uneven ground, provided that the bars 27,27′, 27″, have sufficient flexibility to allow all four feet to rest on the ground under load.

A ladder made be fixed relatively to the device, once it has been adjusted in position with its rungs horizontal, by means of chains or cords 30 which are secured to the device and to the ladder. Such chains or cords may be secured to eyes 31 formed rigidly with the device, or to bars 32 which are pivotal on the bars 27 or 27″ and may be swung inwards to a position in which their free ends are closely adjacent to respective ones of the ladder stiles.

Figures 7, 8:
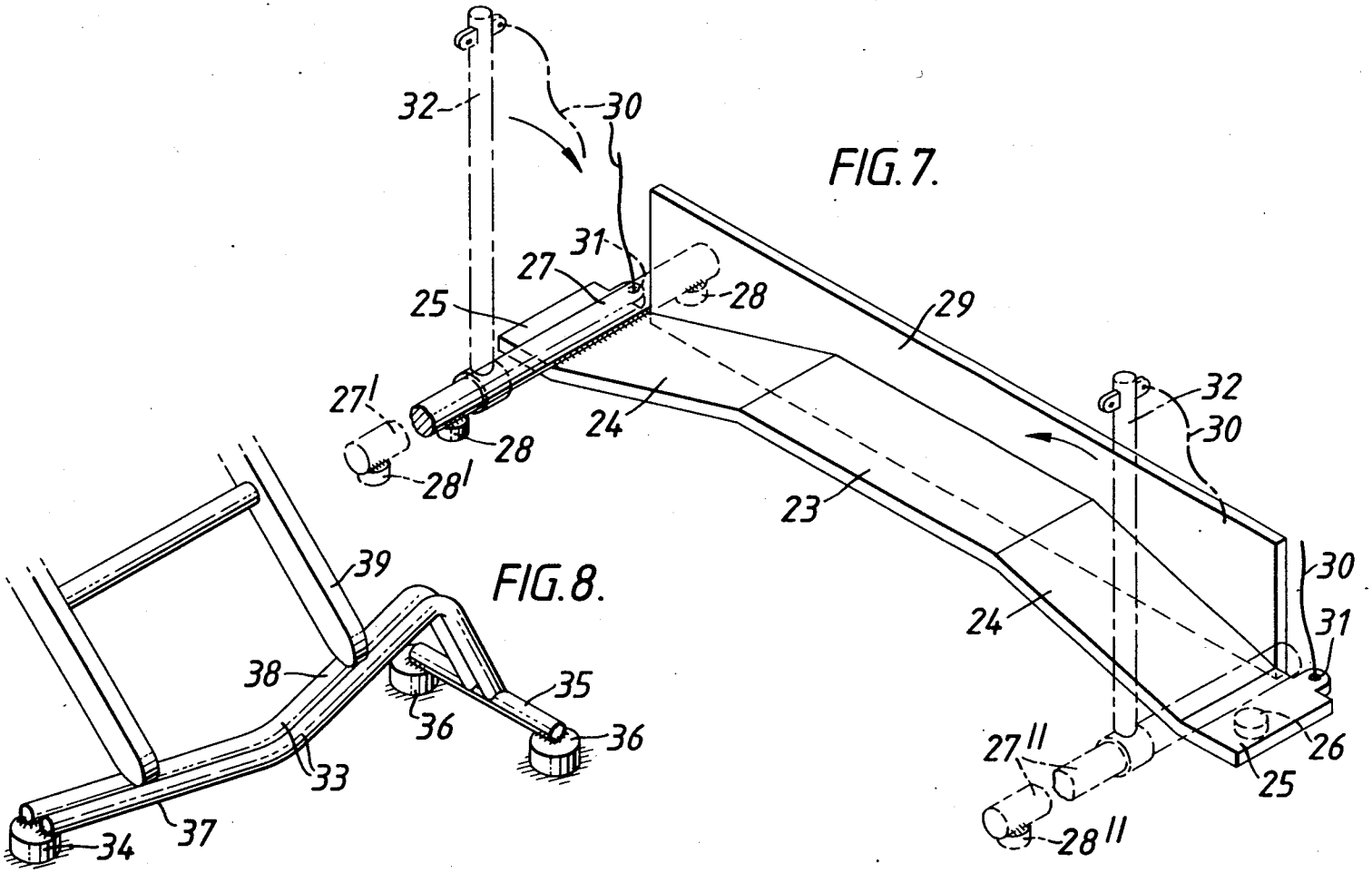
FIG. 7 is a perspective view of a second device.
FIG. 8 is a perspective view of a third device in use.

FIG. 8 shows a similar device, in which the linear support is provided by a pair of tubes or bars 33, which are located side by side and are supported at one end by a foot 34 and at the other end by a bar 35 carrying a pair of feet 36. The bars 30 have a portion 37, which is horizontal when the device is resting on level ground, and an inclined portion 38 so that the device can be adjusted laterally beneath the stiles 39 of the ladder to compensate for any reasonable transverse slope in either direction. The lower ends of the ladder stiles will nest in the gap between the two tubes or bars 33, to provide a reaction towards the wall, inhibiting outward slipping of the ladder away from the wall relatively to the device.

Figure 9:
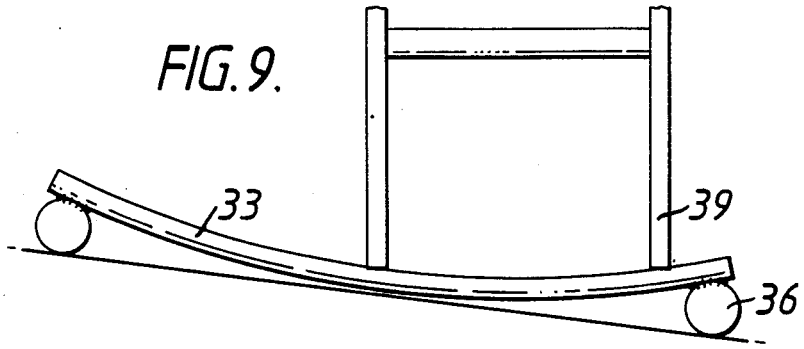
FIGS. 9 and 10 are diamgrammatic views of fourth and fifth devices in use.
Figure 10:
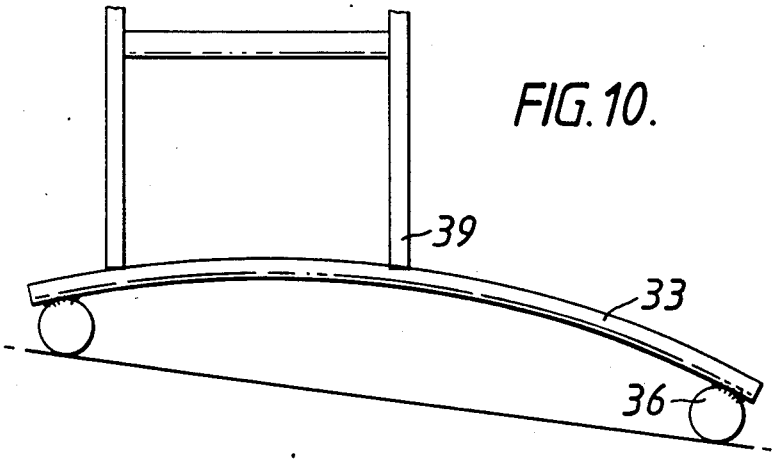

FIGS. 9 and 10 show diagrammatically modifications of the FIG. 8 device, in which the linear support 33 is arcuately concave or convex upwardly. In general an upwardly convex linear support, as shown in FIGS. 7 and 10, is preferred to a concave support as, if the ladder tilts sideways, the stile remaining in contact with the support will tend to move towards a position in which it is normal to the support surface, thus minimising slipping.

Figure 11:
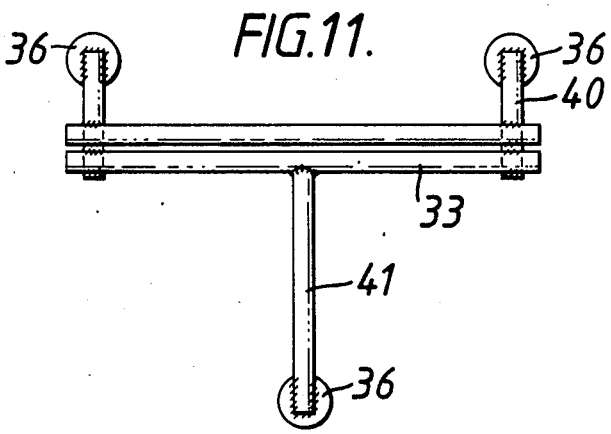
FIG. 11 is a plan of a possible modification to any one of the third, fourth or fifth devices.

FIG. 11 shows how the feet 36 of the examples of FIGS. 8 to 10 may be repositioned, with two projecting on the same side from the linear support 33 on respective short bars 40, and the other foot 36 projecting from the other side of the linear support 33 at the end of a longer bar 41.

I claim:

1. In combination, a ladder and a support device for supporting and leveling the ladder whether on sloping or level ground comprising:

the ladder having ladder rungs and two stiles with stile bottom ends, the stile bottom ends resting on the support device; and the support device, supporting the ladder, comprising a base having an upper surface large enough to support both stile bottom ends, wherein the stile bottom ends rest on the upper surface, and at least three ground engaging spaced feet attached to and adapted to project upwardly and downwardly from said base to engage the ground at separate positions; the upper surface and feet being constructed to present a graded range of heights so that relative heights of the stile bottom ends may be changed by changing the location of said stile bottom ends on said upper surface to position the ladder rungs horizontally; the base being rotatable to adapt to one of a level and a sloping ground to position the ladder rungs horizontally whereby either one of the stile bottom ends can be supported so that it is spaced to a greater extent that the other above the ground.

2. A device according to claim 1, in which the upper surface is the upper surface of a substantially triangular platform having, adjacent to each of its three corners, a respective one of the ground engaging feet.

3. A device according to claim 2, in which, when the device is resting with the feet on level ground, one edge of the upper surface of the triangular platform is horizontal and the opposite corner is at a different height.

4. A device according to claim 3, in which the upper and lower surface, of the platform, with feet projecting therefrom, are mirror images of one another so that the device may be used with a selected one of the platform surfaces uppermost depending on the direction of slope of the ground.

5. A device according to any one of claims 2 to 4, in which the platform comprises a triangular sheet of expanded metal, the edges of which are secured within an inwardly facing channel of a surrounding rigid triangular frame of channel section, the feet being carried by the frame.

6. A device according to claim 1 wherein the base is rotatable about an axis extending substantially perpendicular to a line passing through the stile bottom ends.

7. A device according to claim 1 wherein the base is rotatably reversible to form a mirror image orientation to adapt to ground surface conditions and position the ladder rungs horizontally.

8. In a combination, a ladder and a support device for supporting and leveling the ladder whether on sloping or level ground comprising:

the ladder having ladder rungs and two stiles with stile bottom ends, the stile bottom ends resting on the support device; and the support device, supporting the ladder, comprising a base having an upper surface large enough to support both stile bottom ends rest on the upper surface, and at least three ground engaging spaced feet attached to and projecting downwardly from said base to engage the ground at separate positions; at least two of the ground engaging feet extend outwardly from the base, whereby a broad ground support area is provided, the upper surface and feet being constructed to present a graded range of heights so that relative heights of the stile bottom ends may be changed by changing the locations of said stile bottom ends on said upper surface to position the ladder rungs horizontally; the base being rotatable to adapt to one of a level and a sloping ground to position the ladder rungs horizontally whereby either one of the stile bottom ends can be supported so that it is spaced to a greater extent than the other above the ground.

9. In combination, a ladder and a support device supporting and leveling the ladder whether on sloping or level ground comprising:

the ladder having ladder rungs and two stiles with stile bottom ends, the stile bottom ends resting on the support device; and the support device, supporting the ladder, comprising a base having an upper surface large enough to support both stile bottom ends, wherein the stile bottom ends rest on the upper surface, and at least three ground engaging spaced feet attached to and projecting downwardly from said base to engage the ground at separate positions; the upper surface and feet being constructed to present a graded range of heights so that relative heights of the stile bottom ends may be changed by changing the location of said stile bottom ends on said upper surface to position the ladder rungs horizontally; the base being rotatable whereby either one of the stile bottom ends can be supported so that it is spaced to a greater extent than the other above the ground, said upper surface being provided on a linear support along which the ladder stiles are adjustably positionable, the upper surface extending at an inconstant inclination when said feet are resting on the ground.

10. A device according to claim 9, in which the upper surface is indented to locate the ladder stiles against movement transversely to the length of the support.

11. A device according to claim 9 or claim 10, in which the upper surface has oppositely inclined end portions.

12. A device according to claim 1 in which provision is made for securing the ladder to the device to inhibit a change of the angle at which the ladder extends upwards from the device.

* * * * *